United States Patent [19]

Nishida et al.

[11] Patent Number: 5,070,784

[45] Date of Patent: Dec. 10, 1991

[54] DEVICE FOR DETERMINING AMOUNT OF INK IN INKING ARRANGEMENT

[75] Inventors: Hiroshi Nishida, Tokyo; Daiji Suzuki, Yokohama; Hiroshi Tsuneshige, Tokyo, all of Japan

[73] Assignee: Dai Nippon Insatsu K.K., Tokyo, Japan

[21] Appl. No.: 713,000

[22] Filed: Jun. 10, 1991

Related U.S. Application Data

[63] Continuation of Ser. No. 330,561, Mar. 30, 1989, abandoned.

[30] Foreign Application Priority Data

Mar. 30, 1988 [JP] Japan ..... 63-74619
Jun. 27, 1988 [JP] Japan ..... 63-156838

[51] Int. Cl.[5] ..... B41F 31/04; B41F 33/16
[52] U.S. Cl. ..... 101/365; 101/DIG. 47
[58] Field of Search ..... 101/365, 350, 349, 207-210, 101/363, 366, DIG. 47; 364/400, 526; 250/226

[56] References Cited

U.S. PATENT DOCUMENTS 4,655,135 4/1987 Brovman ..... 101/365 X

FOREIGN PATENT DOCUMENTS 2080201 2/1982 Fed. Rep. of Germany ..... 101/365

*Primary Examiner*—J. Reed Fisher
*Attorney, Agent, or Firm*—Sughrue, Mion, Zinn, Macpeak & Seas

[57] ABSTRACT

A device for determining an amount of ink in an inking arrangement of a printing machine, which has a conversion unit for determining independently a conversion function with respect to each divided blade piece of an ink fountain and for calculating an average value of rotational angle or speed of an ink fountain roller. This construction can cope with a weary of each blade piece and the outer surface of the ink fountain roller.

6 Claims, 10 Drawing Sheets

FIG. 8

AVERAGE MEMORY 24

| ARTICLE | PRINTING UNIT | ROTATIONAL ANGLE θ |
|---|---|---|
| a | $U_Y$ | 57° |
| | $U_M$ | 46° |
| | $U_C$ | 54° |
| | $U_B$ | 52° |
| b | $U_Y$ | 38° |
| | $U_M$ | 42° |
| | $U_C$ | 50° |
| | $U_B$ | 49° |
| c | $U_Y$ | |
| | | |
| | $U_B$ | ⋮ |
| m | $U_Y$ | ⋮ |
| | $U_M$ | ⋮ |
| | $U_C$ | ⋮ |
| | $U_B$ | ⋮ |
| n | $U_Y$ | ⋮ |
| | $U_M$ | ⋮ |
| | $U_C$ | ⋮ |
| | $U_B$ | ⋮ |

FIG. 10

22

MAGNETIC CARD

| ARTICLE | MEASURING AREA OF RATE OF PATTERN AREA | RATE OF PATTERN AREA |
|---|---|---|
| a | $Ar_1$ | 5 |
| | $Ar_2$ | 10 |
| | $Ar_3$ | 8 |
| | ⋮ | ⋮ |
| | $Ar_n$ | 3 |

FIG. 11

17

| ARTICLE | PRINTING UNIT | BLADE | RATE OF PATTERN AREA | RATE OF BLADE SPACE |
|---|---|---|---|---|
| a | $U_Y$ | $B_1$ | 5 | 7 |
| | | $B_2$ | 10 | 10 |
| | | ⋮ | ⋮ | ⋮ |
| | | $B_n$ | 3 | 4 |
| | $U_M$ | $B_1$ | ⋮ | ⋮ |
| | | $B_2$ | ⋮ | ⋮ |
| | | ⋮ | ⋮ | ⋮ |
| | | $B_n$ | ⋮ | ⋮ |
| | $U_C$ | ⋮ | ⋮ | ⋮ |
| | | ⋮ | ⋮ | ⋮ |
| | | ⋮ | ⋮ | ⋮ |
| | | ⋮ | ⋮ | ⋮ |
| | $U_B$ | ⋮ | ⋮ | ⋮ |
| | | ⋮ | ⋮ | ⋮ |
| | | ⋮ | ⋮ | ⋮ |
| | | ⋮ | ⋮ | ⋮ |
| b | $U_Y$ | ⋮ | ⋮ | ⋮ |
| | | ⋮ | ⋮ | ⋮ |
| | | ⋮ | ⋮ | ⋮ |
| | | ⋮ | ⋮ | ⋮ |
| | | ⋮ | ⋮ | ⋮ |
| | | ⋮ | ⋮ | ⋮ |
| | | ⋮ | ⋮ | ⋮ |
| n | $U_Y$ | ⋮ | ⋮ | ⋮ |
| | | ⋮ | ⋮ | ⋮ |
| | | ⋮ | ⋮ | ⋮ |
| | | ⋮ | ⋮ | ⋮ |
| | $U_M$ | ⋮ | ⋮ | ⋮ |
| | | ⋮ | ⋮ | ⋮ |
| | | ⋮ | ⋮ | ⋮ |
| | | ⋮ | ⋮ | ⋮ |
| | $U_C$ | ⋮ | ⋮ | ⋮ |
| | | ⋮ | ⋮ | ⋮ |
| | | ⋮ | ⋮ | ⋮ |
| | | ⋮ | ⋮ | ⋮ |
| | $U_B$ | ⋮ | ⋮ | ⋮ |
| | | ⋮ | ⋮ | ⋮ |
| | | ⋮ | ⋮ | ⋮ |
| | | ⋮ | ⋮ | ⋮ |

FIG. 13

19

| PRINTING UNIT | BLADE | CONVERSION FUNCTION |
|---|---|---|
| $U_Y$ | $B_1$ | $D_{B1}$ |
| | $B_2$ | $D_{B2}$ |
| | ⋮ | ⋮ |
| | $B_n$ | $D_{Bn}$ |
| $U_M$ | ⋮ | ⋮ |
| | ⋮ | ⋮ |
| | ⋮ | ⋮ |
| | ⋮ | ⋮ |
| $U_C$ | ⋮ | ⋮ |
| | ⋮ | ⋮ |
| | ⋮ | ⋮ |
| | ⋮ | ⋮ |
| $U_B$ | ⋮ | ⋮ |
| | ⋮ | ⋮ |
| | ⋮ | ⋮ |
| | ⋮ | ⋮ |

DEVICE FOR DETERMINING AMOUNT OF INK IN INKING ARRANGEMENT

This is a continuation of application Ser. No. 07/330,561, filed Mar. 30, 1989, now abandoned.

BACKGROUND OF THE INVENTION

This invention relates to a printing machine and particularly to a device for determining an amount of ink in a multicolor offset printing machine.

In a multicolor offset printing, four color printing is normally carried out. In the case of four color printing, four printing plates for four colors, that is, yellow, magenta, cyan and black are mounted on four printing units, respectively. Each printing unit has an inking arrangement for adjusting an amount of ink to be supplied.

The inking arrangement has an ink fountain in which a blade assembly is provided along the outer surface of an ink fountain roller. The amount of ink to be supplied is adjusted on the basis of the space between the tip of the blade assembly and the outer surface of the ink fountain roller and on the basis of a rotational angle or speed of the ink fountain roller. The blade assembly is divided into a plurality of blade pieces, each blade piece of which is adjusted independently.

The inking arrangement is controlled by a device for determining an amount of ink to be supplied (hereinafter referred to as a determining device). Into the determining device is inputted data of rates of pattern areas which show distribution of patterns in a predetermined area of a printing plate. The rates of pattern areas are measured with respect to each of four printing plates and are memorized on a medium such as a magnetic card or in a microcomputer.

The determining device has a converting unit for converting a rate of pattern area with respect to each blade piece into a value of the space between the tip of the blade piece and the outer surface of the ink fountain roller on a basis of a predetermined conversion function. On the basis of each value of rates of pattern areas, each blade piece is so adjusted as to move the tip of the blade piece with respect to the circumferential surface of the ink fountain roller. When the space (blade space) between the tip of the blade piece and the outer surface of the ink fountain roller is not suitable, an operator adjusts each blade piece through a key board of a correction input unit. In this manner, an amount of ink supplied from the inking arrangement is adjusted with respect to each printing unit.

However, in the above conventional determining device, there are defects that the tip of each blade piece and the circumferential surface of the ink fountain roller wear gradually with the passage of time thereby to generate a deviation between an initially determined blade space and an actual blade space, and a quality of printing is decreased. The deviation can be eliminated in such a manner that a conversion function is slightly amended or modified to determine a blade space again. However, this determination is not performed with respect to each blade piece of a blade assembly but performed with respect to as a whole with respect to each blade assembly corresponding to each printing unit. Further, the blade assembly and the outer surface of the ink fountain roller do not necessarily wear uniformly through their all regions in its longitudinal direction but may wear partially. In case that there is a large partial wear, a corresponding blade piece is replaced by a new one. In this case, each blade space has to be readjusted to keep the balance between the blade space of a replaced blade piece and the blade spaces of other old blade pieces. This readjustment is performed with respect to each blade piece, and, however, there is a delicate difference in characteristic between one blade piece and other blade pieces. Therefore, the blade spaces of all blade pieces cannot be recovered to their most suitable condition easily and the readjustment need much time and works.

In this manner, in the conventional determining device, as a conversion function is determined as a whole with respect to each printing unit, the determining device cannot cope with a change with the passage of time generated with respect to each blade piece.

Further, in the conventional printing unit, in a case that an amount of ink to be supplied with respect to each printing unit is once determined, the rotational angle and speed of an ink fountain roller is kept at its initially determined value and an adjustment to cope with a wear of the ink fountain roller is not carried out. Accordingly, a precise readjustment of each blade piece must be carried out on the basis of printing data in the past in order to increase quality of printing. In a conventional printing press, whenever the patterns of printing, the kind of color and the order of the printing are changed, the readjustment of rotational angle or speed of the ink fountain roller is needed according to the kind of ink to be supplied because each ink has a different characteristic in viscosity, color or the like.

SUMMARY OF THE INVENTION

It is an object to provide a device for determining an amount of ink in an inking arrangement in which quality of printing can be increased in such a manner that the most suitable conversion function is always determined with respect to each blade piece of a blade assembly to cope with a change with the passage of time and/or that the most suitable rotational angle or speed of an ink fountain roller is always determined according to each printing color to be printed.

According to one aspect of this invention, there is provided a device for determining an amount of ink in an inking arrangement in which a blade assembly is disposed along an outer surface of an ink fountain roller, the blade assembly is divided into a plurality of blade pieces, ink is accommodated between the blade assembly and the outer surface of the ink fountain roller, and a blade space between each blade piece and the outer surface of the fountain roller is determined on the basis of a conversion function for converting a rate of a pattern area at which a certain color occupies in a divided area of a printing plate into a value of a rate of a blade space with respect to a maximum blade space, which comprises: a conversion unit having a conversion function with respect to each divided blade piece for calculating each blade space with respect to each divided blade piece and for updating data of each of conversion function one after another on the basis of the most suitable actual data of the blade spaces in the past; and a control unit for controlling an amount of ink to be supplied, which receives data of the most suitable conversion functions from the conversion unit to command each inking arrangement so as to determine each blade space at the most suitable value.

According to another aspect of this invention, there is provided a device for determining an amount of ink in an inking arrangement which comprises an ink fountain roller and a blade assembly disposed along an outer surface of the fountain roller, which comprises: a rotation control unit for controlling rotation of the ink fountain roller; and a conversion unit for calculating the most suitable value of rotational angle or speed of the ink fountain roller on the basis of the most suitable actual data thereof in the past, the rotation control unit controlling the fountain roller on the basis of the most suitable value.

These and other objects and advantages of the present invention will become manifest by a review of the following description and the accompanying drawings.

BRIEF DESCRIPTION OF THE DRAWINGS

In the accompanying drawings:

FIG. 8 is a table of average values with respect to rotational angles of an ink fountain roller, memorized in an average memory;

FIG. 10 is a plan view of a magnetic card;

FIG. 11 is a table of data of blade spaces, memorized in a printing data memory;

FIG. 13 is a table of conversion function memorized in a conversion function memory;

DETAILED DESCRIPTION OF THE INVENTION

A preferred embodiment of this invention will now be explained with reference to the drawings.

Figure 1:
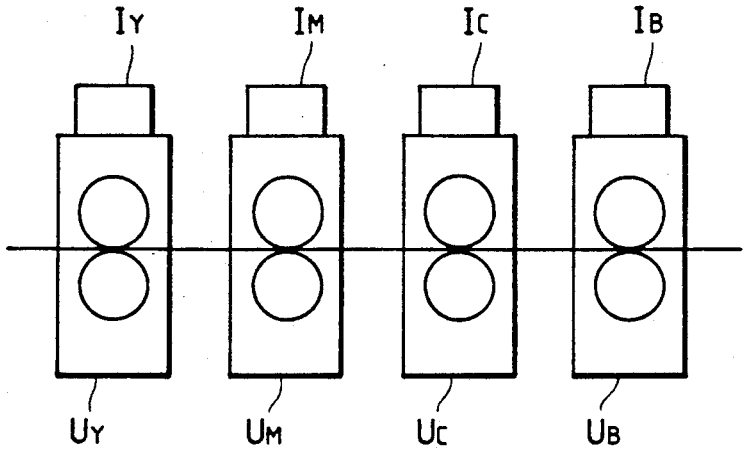
FIG. 1 is a constructual view of a printing machine having a device of this invention.
Figure 2:
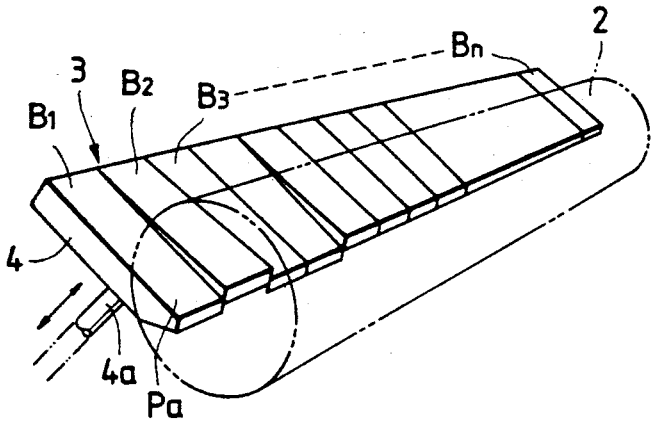
FIG. 2 is a perspective view of an ink fountain.
Figure 3:
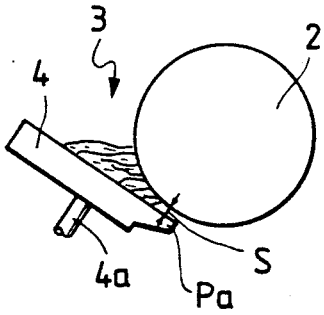
FIG. 3 is a side view of the ink fountain shown in FIG. 2.

In FIG. 1, a multicolor printing machine has four printing units UY, UM, UC, UB on which four printing plates for colors of yellow, magenta, cyan and black are mounted, respectively. On the four printing units UY, UM, UC, UB are mounted four inking arrangements IY, IM, IC, IB for adjusting an amount of ink to be supplied, respectively. Each inking arrangement comprises an ink fountain roller 2 and an ink fountain 3 provided adjacent to the outer surface of the ink fountain roller 2 as shown in FIGS. 2 and 3. The ink fountain 3 has a blade assembly 4 extending in the longitudinal direction of the ink fountain roller 2. The blade assembly 4 is divided into a plurality of blade pieces $B_1, B_2, \ldots B_n$. Each blade piece has an tip Pa which is moved away from and toward the outer surface of the ink fountain roller 2 by an adjusting bar 4*a*. Ink is accommodated between the blade assembly 4 and the outer surface of the ink fountain roller 2, and an amount of ink is supplied through a space (blade space) between the tip of each blade piece and the outer surface of the ink fountain roller 2. The amount of ink supplied from the ink fountain 3 to a plate cylinder (not shown) is determined by the length of the space 5 and the rotational angle or speed of the ink fountain roller 2.

Figure 4:
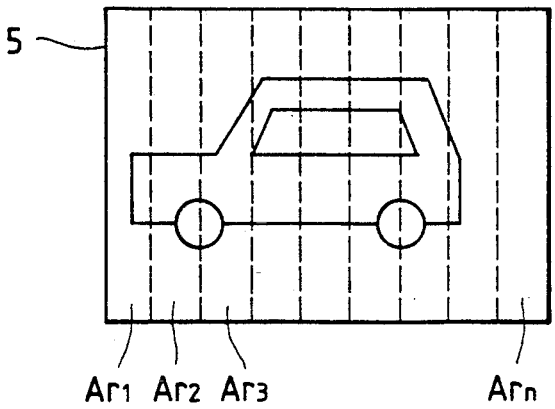
FIG. 4 is a plan view of a printing plate.

The blade pieces $B_1, B_2 \ldots B_n$ correspond to a plurality of divided areas $Ar_1, Ar_2, \ldots Ar_n$ of a printing plate 5(FIG. 4), respectively. With respect to each area of the printing plate 5, a rate of a pattern area is measured by a pattern area measuring apparatus (not shown) which optically measures distribution of patterns on the printing plate to determine an amount of ink to be supplied from the ink fountain 3 to the plate cylinder. The rate of a pattern area is a rate at which a certain color occupies in each divided area on the printing plate 5. The rate of a pattern area is measured with respect to four printing plates corresponding to four printing units UY, UM, UC, UB. The measured values of the rates of pattern areas are memorized on a magnetic card or in a microcomputer.

Figure 5:
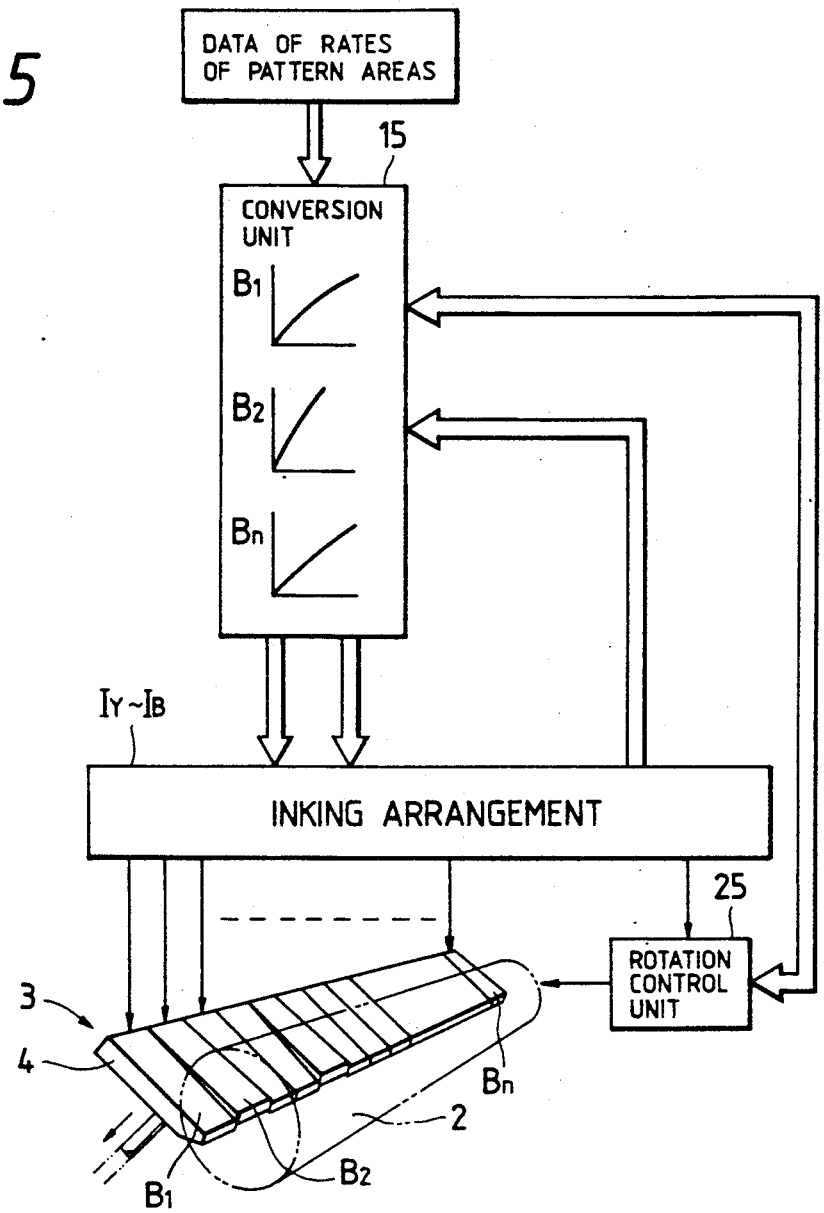
FIG. 5 is a block diagram showing construction of a device for determining an amount of ink according to this invention.
Figure 6:
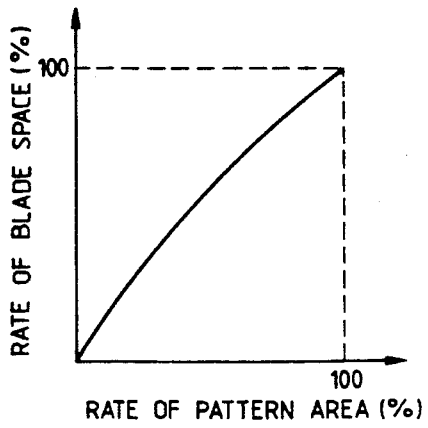
FIG. 6 is a graph showing a conversion function with respect to a rate of a pattern area.

A device for determining an amount of ink to be supplied according to this invention comprises, as shown in FIG. 5, a conversion unit 15 having a conversion function with respect to each blade piece for converting a rate of a pattern area into a value of the space between the tip Pa of each blade piece and the outer surface of the ink fountain roller 2 on the basis of conversion function data. The conversion function data are indicated by a graph as shown in FIG. 6. That is, in FIG. 6, the ordinate indicates rates (%) of blade spaces S between blade pieces and the outer surface of the ink fountain roller with respect to its maximum blade space, and the abscissa indicates rates of pattern areas. The output of the conversion unit 15 is transmitted to a corresponding inking arrangement IY, IM, IC or IB to adjust each blade space S. Further, the ink fountain roller 2 is controlled by a rotation control unit 25 which is connected to the inking arrangement and the conversion unit 15. That is, the ink fountain roller 2 is rotated continuously or intermittently. In the case of its continuous rotation, its rotational speed is determined at a certain value according to color (density, color balance or the like) to be printed. On the contrary, in the case of its intermittent rotation, its rotational angle is determined at a certain value according to color to be printed.

Figure 7:
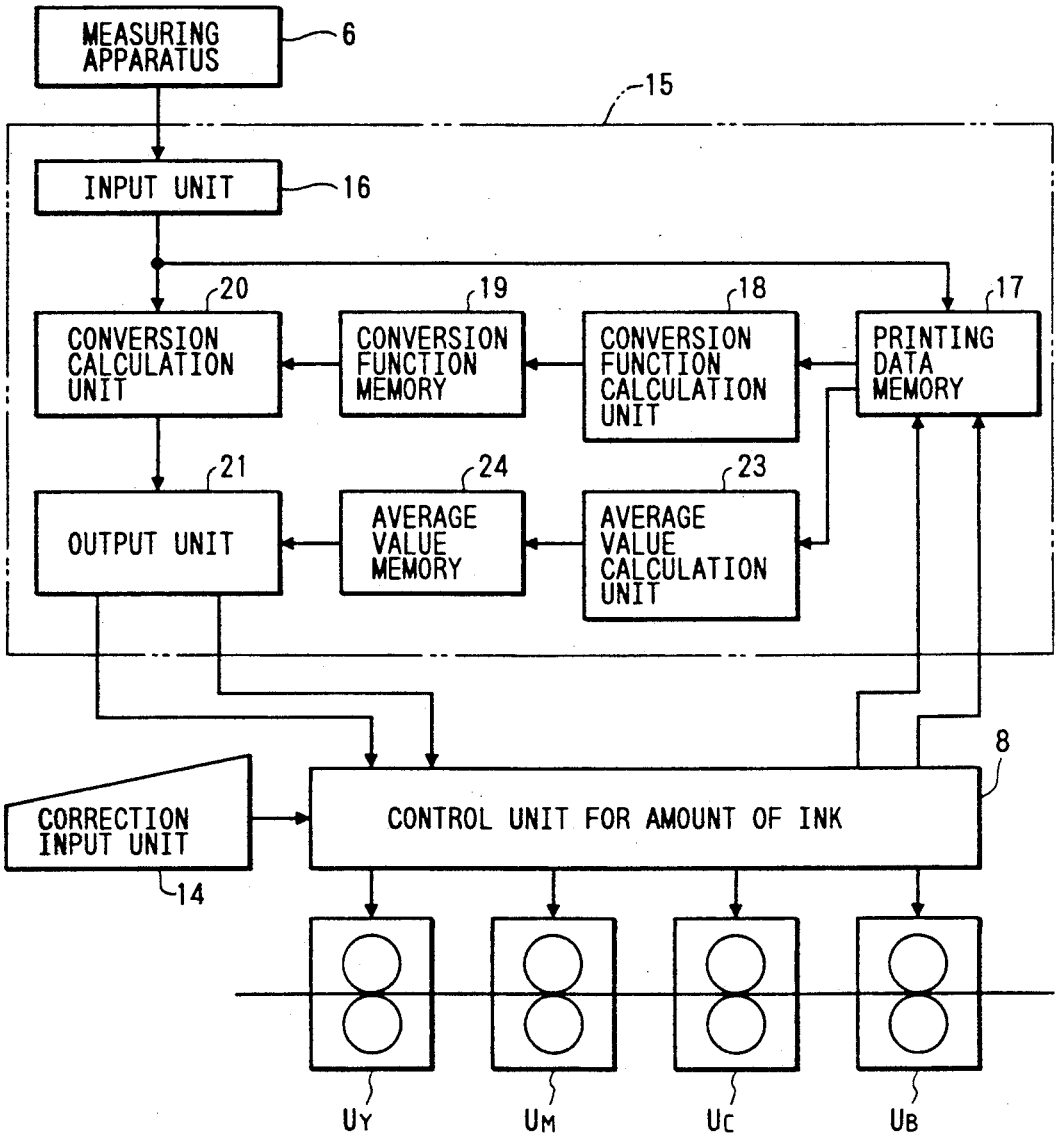
FIG. 7 is a block diagram showing construction of the device of this invention in more detail.

The conversion unit 15 comprises, as shown in FIG. 7, an input unit 16 into which data of rates of pattern areas measured by a pattern area measuring apparatus 6 are inputted, a printing data memory 17 for memorizing data of rates of pattern areas inputted from the input unit 16, most suitable blade spaces with respect to each blade piece corresponding to each printing plate and the rotational speed or angle with respect to each fountain roller, a conversion function calculation unit 18 for calculating conversion functions by which the data of rates of pattern areas can be converted into data of blade spaces on the basis of data outputted from the memory 17, a conversion function memory 19 for memorizing conversion functions calculated by the unit 18 with respect to each blade piece $B_1, B_2 \ldots B_n$, a conversion calculation unit 20 for reading out a corresponding conversion function from the memory 19 to calculate the most suitable blade space with respect to each of blade pieces $B_1, B_2 \ldots B_n$ on the basis of data of rates of pattern reas inputted from the input unit 16, an average value calculation unit 23 for calculating the most suitable valve, e.g., an average value of rotational angle $\theta$ or speed of each ink fountain roller 2, which (angle or speed) is read out of the memory 17, an average value memory 24 for memorizing the calculated average value of the rotational angle $\theta$ or speed thereof with respect to each of printing units UY, UM, UC, UB and an output unit 21 for outputting the most suitable blade spaces S and for commanding a control unit 8 for controlling an amount of ink to be supplied so as to rotate each fountain roller at a rotational angle or speed.

The input unit 16 comprises a magnetically reading device for reading data of a magnetic card or a key board through which an operator inputs data of rates of pattern areas by pushing keys while he sees data printed on a paper which is outputted from the pattern area measuring apparatus 6. The printing data memory 17 memorizes the most suitable values for a predetermined number of articles to be printed. The most suitable blade spaces and a rotational angle or speed of each ink fountain roller are determined in consideration of articles to be printed.

Figure 9:
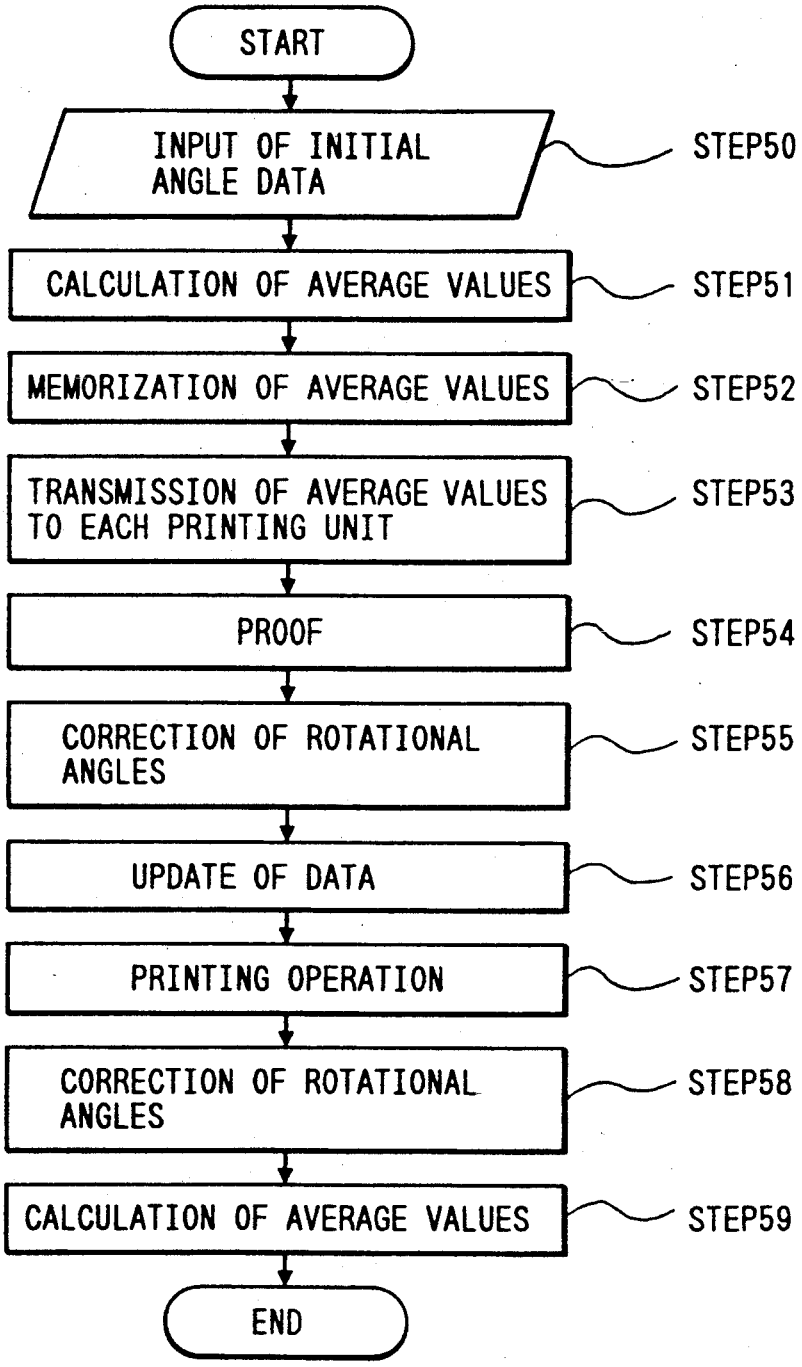
FIG. 9 is a flow chart showing an adjusting operation of the rotational angles of each ink fountain roller.

The determining operation of a rotational angle $\theta$ of the ink fountain roller will now be explained with reference to FIGS. 7 to 9.

First, an initial value of the rotational angle $\theta$ is determined. The initial rotational angles $\theta$ are inputted in the printing data memory 17 through the input unit 16 with respect to each of articles a, b, . . . n to be printed and each of printing units UY, UM, UC, UB (hereinafter referred to as preset data) (STEP 50). The preset data are read out by the average value calculation unit 23. The unit 23 calculates average values $\theta$Y, $\theta$M, $\theta$C, $\theta$B of the rotational angles $\theta$ on the basis of the preset data read out of the memory 17 (STEP 51). The average values $\theta$Y, $\theta$M, $\theta$C, $\theta$B are memorized in the average value memory 24(STEP 52). Then data $\theta$Y, $\theta$Y, $\theta$C, $\theta$B are read out of the memory 24 to transmit the data to each of the printing units UY, UM, UC, UB through the output unit 21 and the control unit 8(STEP 53). Thus, data of rotational angles $\theta$ of the ink rollers 2 are initially determined.

In this embodiment, the most suitable value of the rotational angle $\theta$ of each fountain roller 2 is determined by obtaining an average value and, however, its most suitable value may be obtainable by other methods.

Thereafter, a proof or a test printing operation is carried out by driving each printing unit in order to judge whether or not the rotational angles $\theta$Y, $\theta$M, $\theta$C, $\theta$B are suitable (STEP 54). An operator judges whether or not each angle $\theta$ is proper while investigating the article having been printed. As a result, if the angles are not suitable, the operator determines manually new rotational angles $\theta$Y, $\theta$M, $\theta$C, $\theta$B through a correction input unit 14 by a keyboard (STEP 55). These newly determined data are memorized in the printing data memory 17 through the control unit 8. At this time, data in the memory 17 are updated (STEP 56). Thereafter, when a printing operation is performed, the corrected rotational angle data $\theta$Y, $\theta$M, $\theta$C, $\theta$B are outputted to the output unit 21 through the average value calculation unit 23 and the average value memory 24 and are then transmitted to a driving unit of each of printing units UY, UM, UC, UB (STEP 57). In this case, at the early stage in which each angle $\theta$ is initially determined, there are not enough sample data to calculate average values by the average value calculation unit 23. Thereafter, the rotational angles $\theta$ are determined on the basis of initial values of data of the rotational angles or their respective correction values until a predetermined number of data are accumulated in the printing data memory 17.

While a printing operation is repeated, the operator investigates the quality of printed articles to the rotational angles $\theta$Y, $\theta$M, $\theta$C, $\theta$B through the correction input unit 14 (STEP 58). These corrected data are the most suitable values for the conditions of the ink fountain rollers or characteristics of ink to be used at that time and are memorized as the most suitable actual data in the printing data memory 7 throught the control unit 8. When a predetermined number of the actual data are accumulated, the average calculation unit 23 calculates the average values of accumulated actual data, which are memorized in the average value memory 24 (STEP 59). Thereafter, until a predetermined number of the actual data are accumulated in the printing data memory 17, the rotational angles $\theta$Y, $\theta$M, $\theta$C, $\theta$B of each ink fountain roller are controlled on the basis of the average values calculated at that time.

In this manner, when a predetermined number of actual data of rotational angles are accumulated, the most suitable values are averaged to obtain their average values, on the basis of which the rotational angles $\theta$Y, $\theta$M, $\theta$C, $\theta$B of each ink fountain roller are controlled.

The calculation of the average values contributes to average the quality of printed articles because rotational angle data are not partial to those of specific samples.

Likewise, the actual rotational angle data in the past are used in a feedback form to obtain the most suitable values which are updated one after another in the printing data memory 17. That is, this self-learning of rotational angles enables the printed articles to keep their high quality.

The above explanation concerns only the rotational angles of the ink fountain rollers 2 and, however, the above operation can be adapted to obtain the most suitable rotational speeds of the ink fountain rollers 2 in the same manner.

Next, the determining operation of the blade spaces will be explained with reference to FIGS. 7 and 10 to 15.

Figure 12:
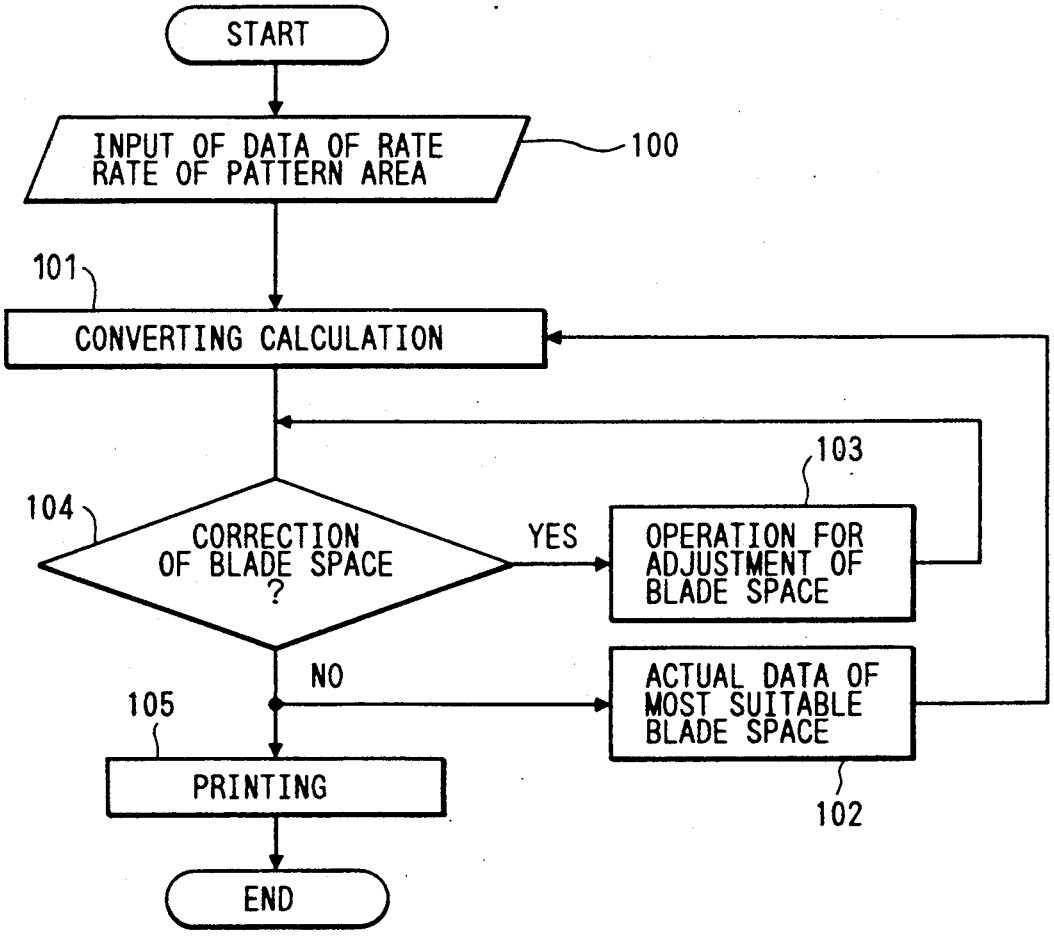
FIG. 12 is a flow chart showing an adjusting operation of blade spaces of each blade assembly.

First, the initial determination of the blade spaces is performed by using a magnetic card 22 as shown in FIG. 10. Data of rates of pattern areas are memorized on the magnetic card 22 with respect to the divided areas $Ar_1$, $Ar_2$. . . $Ar_n$ of each printing plate 5 (FIG. 4) for each article to be printed. The format is shown in FIG. 10. The data of rates of pattern areas are, as shown in FIG. 12, read out by the input unit 16 (card reader) and inputted into the converting calculation unit 20 to convert the data of rates of pattern areas into the data of blade spaces on the basis of the conversion functions inputted from the conversion function memory 19 (STEP 100).

That is, in the printing data memory 17 are memorized, as shown in FIG. 11, data of rates of pattern areas with respect to each of divided areas of each printing plate, which (data) are determined initially with respect to the printing machine and data of rates of blade spaces corresponding to the divided areas of each printing plate 5 with respect to each article to be printed, with respect to each of the printing units UY, UM, UC, UB and with respect to each of blade pieces $B_1$, $B_2$. . . $B_n$. These preset data are read out by the conversion function calculation unit 18 one after another. The unit 18 calculates conversion functions $DB_1$, $DB_2$. . . $DB_n$ corresponding to each of blade pieces $B_1$, $B_2$. . . $B_n$ in each of printing units UY, UM, UC, UB on the basis of the preset data read out of the data memory 17. These calculated data $DB_1$, $DB_2$. . . $DB_n$ are, as shown in FIG. 13, memorized in the conversion function memory with respect to each blade piece of each printing unit. The conversion calculation unit 20 reads out each corresponding conversion function from the conversion function memory 19 when data of rates of pattern areas are inputted thereinto, and the unit 20 calculates rates of blade spaces corresponding to data of rates of pattern areas inputted therein (STEP 101). These calculated rates of blade spaces are outputted to the control unit 8 for controlling an amount of ink.

The above operation is performed only when a printing machine is new and the blade pieces $B_1$, $B_2$. . . $B_n$ of each ink fountain 3 are not worn. The calculation of rates of blade spaces is performed by using the preset data without consideration of a change with the passage of time in the tip of each blade piece.

However, repetition of printing operation changes not only characteristic or nature of each blade piece but also the outer surface of each ink fountain roller 2 due to its wear or the like.

Therefore, in the conversion unit 15 of this embodiment, the most suitable actual data of rates of blade spaces in the past are inputted into the printing data memory 17 in a feedback form to update the old data and to memorize the most suitable actual data when a proof is repeated to obtain the most suitable actual data, and the proof is performed while the blade spaces 5 are corrected. This correction operation will be explained after in STEP 104. The judgement as to whether or not the actual data of the rates of blade spaces are the most suitable ones is carried out by investigating the printed articles. That is, the actual data of the most suitable blade spaces are memorized in the printing data memory 17 one after another during a certain number of printing operations and the data are updated one after another. The printing data memory 17 memorizes, for example, ten data in the past with respect to each of data of rates of blade spaces, and the conversion function calculation unit 18 calculates the most suitable conversion function by using the ten data in the past.

Figure 14:
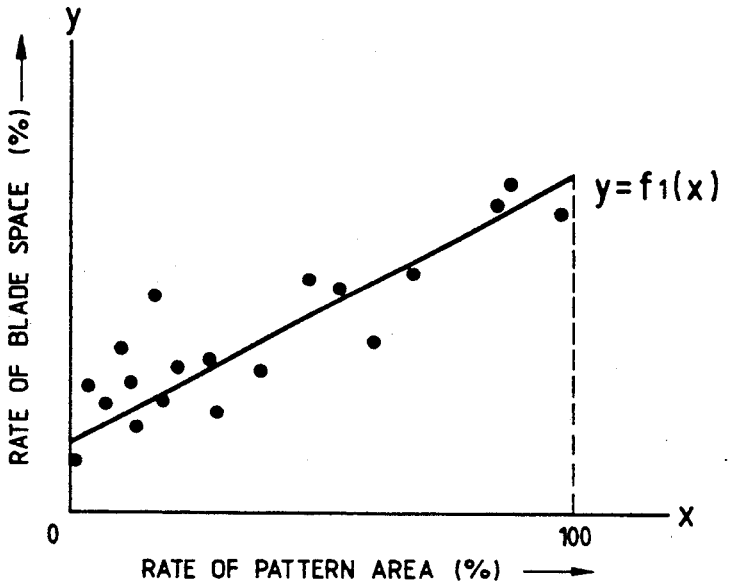
FIG. 14 is a graph showing a method of least squares.
Figure 15:
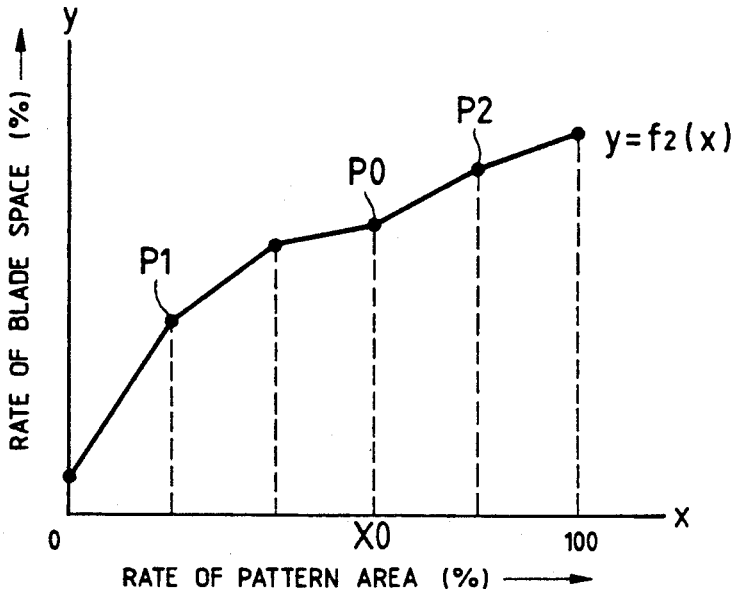
FIG. 15 is a graph showing a method of obtaining average values of rates of pattern areas.

The conversion function calculation unit 18 reads out some data of rates of pattern areas and actual data of the most suitable blade spaces, and calculates new conversion functions by a method of least squares as shown in FIG. 14 or a method for obtaining an average value with respect to each rate of pattern area as shown in FIG. 15.

In FIG. 14, rates of blade spaces y is expressed as a functional expression $Y=f1\ (x)$ in which the rate of pattern area x is variable. For example, if the rate of blade space y is expressed as an expression such as $Y=ax^b$, the respective values of the coefficient a and a degree b should be determined by self-learning. That is, the coefficient a and a degree b are determined by the method of least squares.

Further, in FIG. 15, first, an average value in the X-axis direction is calculated on the basis of much data and then an average value in the Y-axis direction is calculated to obtain an average coordinate P0. Next, an average coordinate P1 is calculated in a range 0% to X0% in the X-axis, and then an average coordinate P2 is calculated in a range X % to 100% in the X-axis. In this manner, each average coordinate is calculated one by one.

These newly calculated conversion functions are transmitted to the conversion function memory 19 to replace each old conversion function with each corresponding new conversion function. These new conversion functions are used by the conversion calculation unit 20 and data of the most suitable blade spaces are always outputted from the output unit 21.

In this manner, the present data determined initially are updated or replaced by new data one after another through a self-learning as a printing operation is repeated, and the blade spaces adapted to a change with the passage of time in each blade piece, are always calculated. The updating operation of the data is not necessarily carried out whenever a printing operation is performed and the period of updating may be so determined as to relate to a change with the passage of time (STEPS 101 and 102).

Next, data of the most suitable blade spaces are inputted into the control unit 8 which gives command signals to the inking arrangements IY, IM, IC, IB of the printing units UY, UM, UC, UB on the basis of the data of the most suitable blade spaces, respectively. Each inking arrangement operates each blade pieces independently to adjust each blade space at the most suitable value (STEP 103).

Thereafter, a proof or a test printing, operation is carried out at a rate of blade space adjusted.

If a printed article is not good in quality, the operator adjusts the blade spaces S which are improper while investigating the printed article (STEP 104). The most suitable actual data finally determined are inputted into the printing data memory 17 in a feedback form. The printing operation is performed at a blade space determined in this manner. When a printing plate 5 is replaced by a new printing plate to print a new article, these operations are repeated in the same manner. During this repetition, the conversion functions of the converting unit 15 are corrected by a self-learning in response to a change with the passage of time in each blade piece and a change with the passage of time on the outer surface of the ink fountain roller to obtain the conversion functions for the most suitable blade spaces.

In this invention, the adjustment of blade spaces are not performed as a whole with respect to each blade assembly but performed independently with respect to each of blade pieces $B_1$, $B_2$, . . . $B_n$ of each inking arrangement. Accordingly, the unbalance or non-uniformity among the blade pieces $B_1$, $B_2$, . . . , $B_n$ can be corrected thereby to enable a precise adjustment. This contributes to increase quality of printed articles and to save works by an operator or time for a proof.

Further, in this invention, as data of the rotational angles $\theta$ or speed of the ink fountain roller are updated during repetition of the printing operations, each ink fountain roller 2 is rotated at the most suitable rotational angle or speed adapted to a change of the ink fountain roller or characteristic of ink. This not only increases quality of printed articles but also facilitates its maintenance.

What is claimed is:

1. A device for determining an amount of ink in an inking arrangement for supplying ink to a printing plate which is supported by a plate cylinder and which has thereon pattern areas to receive the ink to be printed, wherein said inking arrangement has blade assembly means disposed along an outer surface of an ink fountain roller rotating at a predetermined speed for feeding the ink to the printing plate on the plate cylinder in cooperation with the blade assembly means, with the blade assembly means being divided into a plurality of blade pieces, and said inking arrangement further has ink accommodated between the blade assembly means and the outer surface of the ink fountain roller, and has a blade space between each blade piece and the outer surface of the fountain roller, with the blade space of each blade piece being determined independently in accordance with a rate of a pattern area at which a certain color occupies a predetermined divided area, corresponding to a blade piece, of the printing plate, said device comprising:

a) means for measuring the rate of pattern area in the divided area of the printing plate;

b) conversion unit means connected to the rate of pattern area measuring means and having a separate conversion function indicating a relationship between the rate of pattern area and each blade space corresponding to each divided blade piece, said conversion unit means calculating each blade space for each divided blade piece, and updating data of each separate conversion function on the basis of a predetermined number of data of preceding blade space value corresponding to the divided blade piece to obtain a most suitable blade space of each blade piece; and c) control unit means connected to the conversion unit means for controlling an amount of ink to be supplied, said control unit means receiving data of separate conversion functions from the conversion unit means to command an adjusting member for adjusting each blade space so as to determine each blade space at a most suitable value to supply an optimum delivery amount of ink to effect quality printing.

2. A device according to claim 1, further comprising:

a) rotation control unit means for controlling rotation of the ink fountain roller; and b) conversion unit means for calculating the most suitable value for rotational speed of the ink fountain roller on the basis of a predetermined number of preceding rotational speeds of the ink fountain roller, the rotation control unit means controlling the fountain roller on the basis of the most suitable value.

3. A device according to claim 2, wherein the conversion unit means comprises:

printing data memory means for memorizing said predetermined number of preceding rotational speeds of the ink fountain roller average value calculation unit means for calculating an average value from preceding rotational speeds outputted from the printing data memory means, and for outputting said average value as said most suitable value.

4. A device according to claim 1, wherein said conversion unit means comprises:

input unit means connected to the rate of pattern area measuring means, into which data of rates of pattern areas at which each color occupies in predetermined divided areas of the printing plate as measured by a pattern area measuring apparatus for measuring a rate of pattern area in each divided area of the printing plate with respect to each color, are inputted;

printing data memory means connected to the input unit means and the control unit for memorizing data of rates of pattern areas inputted from the input unit means and data of blade spaces inputted from the control unit means with respect to each blade piece;

conversion function calculation unit means for calculating a conversion function representative of a relationship between a rate of pattern area in a divided area of the printing plate and a blade space of each blade of the blade assembly on the basis of data of rates of pattern areas and data of respectively corresponding blade spaces outputted from the printing data memory means; and conversion calculation unit means disposed between the input unit and the control unit for calculating a most suitable blade space of each blade pieces, corresponding to a rate of pattern area in a divided area of the printing plate, on the basis of the conversion function calculated by the conversion function calculation unit means, data of the most suitable blade space calculated by the conversion calculation unit means being sent to the control unit for adjusting a blade space of each corresponding blade piece through the adjusting member.

5. A device according to claim 4, wherein the conversion unit means further comprises conversion function memory means disposed between the conversion function calculation unit and the conversion calculation unit for memorizing data of conversion functions calculated by the conversion function calculation unit means.

6. A device according to claim 3, wherein the conversion unit means further comprises average value memory means connected to the average value calculation unit for memorizing data of average values calculated by the average value calculation unit means.

* * * * *